United States Patent [19]

Mayer

[11] 4,403,173

[45] Sep. 6, 1983

[54] IGNITER CIRCUIT FOR HIGH-PRESSURE METAL VAPOR DISCHARGE LAMP

[75] Inventor: Walter Mayer, Taufkirchen, Fed. Rep. of Germany

[73] Assignee: Patent-Treuhand-Gesellschaft für Glühlampen mbH, Munich, Fed. Rep. of Germany

[21] Appl. No.: 350,043

[22] Filed: Feb. 18, 1982

[30] Foreign Application Priority Data

Mar. 6, 1981 [DE] Fed. Rep. of Germany ..... 3108548

[51] Int. Cl.[3] ..... H05B 37/00; H05B 39/00; H05B 41/14

[52] U.S. Cl. ..... 315/289; 315/209 CD

[58] Field of Search ..... 315/127, 209 CD, 219, 315/223, 239, 240, 244, 289, 290

[56] References Cited

U.S. PATENT DOCUMENTS

| | | | |
|---|---|---|---|
| 4,210,850 | 7/1980 | Britton | 315/240 |
| 4,275,337 | 6/1981 | Knoble et al. | 315/244 |
| 4,326,149 | 4/1982 | Wyner et al. | 315/289 |

FOREIGN PATENT DOCUMENTS

| | | | |
|---|---|---|---|
| 52-19481 | 2/1977 | Japan | 315/290 |

*Primary Examiner*—Alfred E. Smith
*Assistant Examiner*—Robert E. Wise
*Attorney, Agent, or Firm*—Frishauf Holtz, Goodman & Woodward

[57] ABSTRACT

To provide for reliable starting of lamps under cold or warm condition, by pulse superimposition circuitry, an auxiliary capacitor (11) and a serially connected damping resistor (12) are integrated in the starter or igniter circuit. The series circuit of the auxiliary capacitor (11) and the damping resistor (12) forms, together with a choke or ballast (2) a series oscillatory circuit which is directly connected to act on the primary (8) of the pulse transformer (4, 13) and increases the lamp supply voltage during ignition. A semiconductor switching element (9), such as a four-layer diode, disconnects the oscillatory circuit after ignition, also interrupting the supply for the series oscillatory circuit, so that the lamp, after ignition, will receive only normal network supply power.

8 Claims, 2 Drawing Figures

IGNITER CIRCUIT FOR HIGH-PRESSURE METAL VAPOR DISCHARGE LAMP

The present invention relates to a circuit to start or ignite a high-pressure metal vapor discharge lamp, and more particularly to a starter or igniter circuit which is adapted to start sodium or halogen metal vapor high-pressure lamps by superimposing starting pulses on the operating energy supply of the lamp, utilizing a starter or igniter capacitor.

BACKGROUND

It is known to start high-pressure metal vapor discharge lamps such as sodium or halogen metal vapor high-pressure discharge lamps by applying a starting pulse thereto, obtained upon discharge of a starting capacitor. The starting capacitor is serially connected with a damping resistor. The circuits are suitable to start cold discharge lamps as well as to re-start or re-ignite already warm high-pressure metal vapor discharge lamps. The starter or igniter circuit is connected as a series circuit by a manually operated switch or by a relay contact connected to the auxiliary apparatus for starting the lamp.

Starter or igniter circuits of this type are expensive and require much material; they are sensitive to temperature changes and, particularly the current carrying terminals, are subject to malfunction.

After a lamp has started, further starter or ignition pulses should be suppressed; in superimposed starting circuits, it has been proposed to use semiconductor circuitry to suppresss further starting pulses. Yet, these circuits heretofore did not operate with sufficient reliability, that is, starting was then not insured. Some lamps are difficult to start, and particularly with such lamps, starting reliability was subject to improvement.

THE INVENTION

It is an object to provide a starting circuit or a starting system utilizing a superimposed starting pulse, in which the starting pulse disconnection function is electronically controlled, and which, still, is reliable to insure starting under cold as well as under warm conditions of any lamp, even those which are subject to starting difficulties. Additionally, the circuit should be simple and use only few components so that it can be manufactured inexpensively.

Briefly, a series circuit is formed of an auxiliary capacitor and a damping resistor, integrated or integrally connected in the superpositioned pulse ignition circuit, and forming, together with the auxiliary or ballast apparatus, such as a choke, a series oscillatory circuit which acts on the primary winding of the starter pulse transformer, and thus enhances or increases the lamp supply voltage. A semiconductor with a predetermined voltage, such as a symmetrically switching semiconductor element, for example a four-layer diode or a suitably controlled triac, is used to disconnect the ignition pulses after the lamp has started or fired.

The circuit has the advantage that cold lamps, as well as lamps which have starting difficulties, can be started and, further, that the circuit is also applicable to warm lamps. It results in reliable and rapid starting. The inductive accessory apparatus, typically a choke or starter ballast, is used for the series oscillatory circuit and, since an already existing element of the starting circuit is used, the requirement for additional circuit components is reduced. Simultaneously, the superimposition of the currents from the choke or starter ballast and the auxiliary starting capacitor prevents a current pause after lamp ignition or lamp starting.

A symmetrically starting semiconductor switch permits starting of the lamp during any half-wave of supply current. The ignition capacitor can be integrated with the associated damping resistor in the pulse superimposition circuitry. The connection to the primary winding of the pulse transformer results in a compact starting or ignition accessory apparatus which, with high idling voltage during lamp ignition, provides a double pulse with extremely rapid pulse sequence.

DRAWINGS

Figure 1:
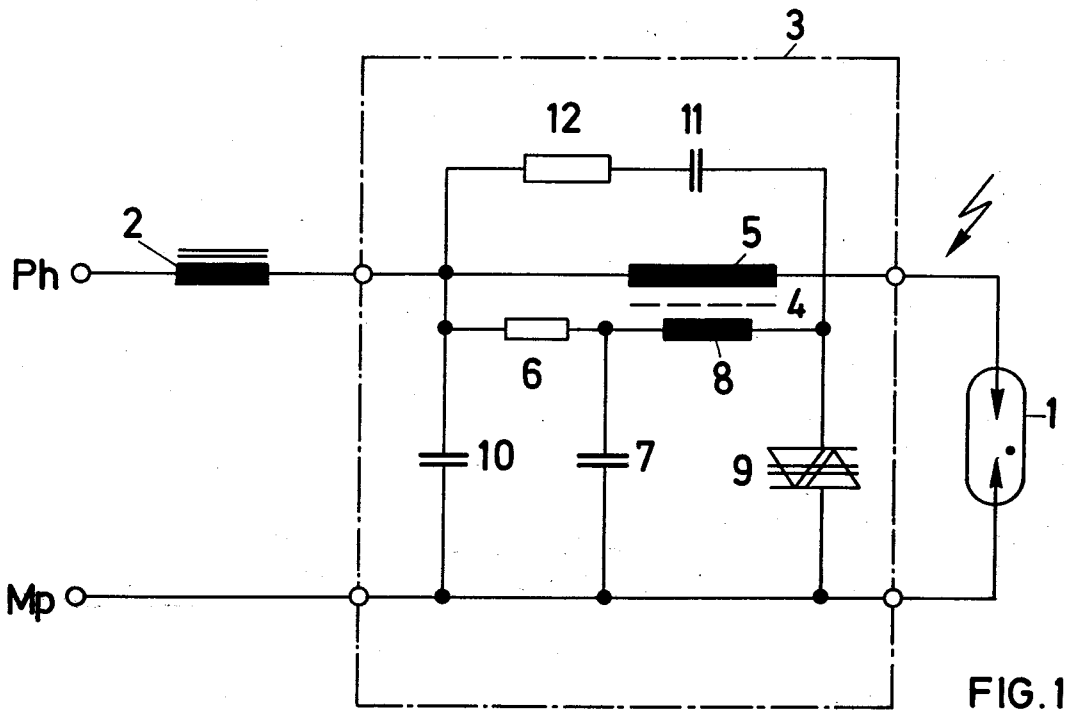
FIG. 1 is a general circuit diagram of the igniter or starter circuit.

A high-pressure metal vapor discharge lamp 1 has its terminals connected through a starter unit 3. The starter unit 3 is connected through a choke or ballast 2 to one terminal Ph, forming the phase terminal of a power supply, for example at 50 or 60 Hz. The other terminal of the starter or igniter circuit 3 is connected to the reference or ground or center terminal Mp.

The circuit of the starter or igniter unit 3 has a pulse transformer 4, the secondary winding 5 of which is connected in the power circuit of terminal Ph between the lamp 1 and the choke 2. A pulse capacitor 7 and a charge resistor 6, forming a series circuit, are connected across the secondary winding 5 of transformer 4 and of the lamp. The pulse capacitor 7 is, in turn, connected across a series circuit formed by the primary winding 8 of the pulse transformer 4 and a symmetrically switching four-layer diode 9. The series circuit of the secondary winding 5 and lamp 1 additionally is short-circuited by a radio interference or high-frequency short-circuiting capacitor 10.

An additional auxiliary ignition capacitor 11, serially connected with a damping resistor 12, is further provided, connected in parallel to the series circuit formed by the primary winding 8 of the pulse transformer 4 and of the charge resistor 6. This series circuit is additional to the pulse superimposition circuit previously described. The series circuit of the auxiliary capacitor 11 and of the damping resistor 12, together with the symmetrically switching four-layer diode 9, forms a further series circuit which is parallel to the series circuit formed by the charge resistor 6 and the pulse capacitor 7.

Operation

The pulse capacitor 7 is charged over the charge resistor 6 until the capacitor 7 receives a charge voltage which corresponds to the breakdown voltage or switching voltage of the four-layer diode 9. At this point, the resistance of the four-layer diode 9 drops to practically zero, permitting the pulse capacitor 7 to discharge through the primary 8 of the pulse transformer 4. The voltage drop in the primary winding 8 is transformed by the turn ratio of the pulse transformer, to obtain a high-voltage pulse of between 2 kV to about 5 kV-depending on the transformation ratio of the pulse transformer 4. This pulse is applied to the lamp 1. Simultaneously, and while the four-layer diode 9 is still conductive, a series oscillatory circuit is formed via the choke 2, damping resistor 12, and auxiliary capacitor 11. The relative components are so matched that the oscillating frequency is about 1 kHz. This leads to additional voltage increase, connected in parallel to the high-frequency radio suppression capacitor 10 which, then, also is applied to the lamp.

After the pulse capacitor 7 has discharged, and the voltage has again dropped below the switching voltage of the four-layer diode 9, the four-layer diode 9 will block as the current changes polarity. The series circuit formed by the choke 2, the damping resistor 12, and the auxiliary capacitor 11, also is interrupted. Yet, at the same time, the pulse capacitor 7 is being charged again over the charge resistor 6 and by the energy formed by excess voltage across the noise suppression capacitor 10. This renewed charge applied to the capacitor 7 causes a rise in voltage across the four-layer diode 9 which, again, becomes conductive. This causes a renewed ignition pulse to be supplied which is in the same half-wave of the network supply voltage as the first ignition pulse. The two pulses may follow each other by only about 0.5 millisecond.

A cold lamp may not have fired or have been started at the first ignition pulse; the second ignition pulse, however, will cause reliable starting. During starting or ignition, a voltage of about 400 V is applied to the lamp. Since the currents from the choke 2 and of the auxiliary capacitor 11 are superimposed at the instant of lamp starting, the pause of current supply which occurred in prior art ignition systems is eliminated. Thus, extinction of the lamp 1 immediately after a first start will not occur. After starting, only the lamp operating voltage is applied to the system. The four-layer diode 9 becomes non-conductive, and thus disconnects the auxiliary capacitor 11 and the serially connected damping resistor 12. This de-activates the starting or ignition circuit. The high-frequency short-circuiting capacitor 10 short-circuits high-frequency pulses and ignition voltage peaks so that they will not reach the supply network where damage or interference may be caused thereby.

Figure 2:
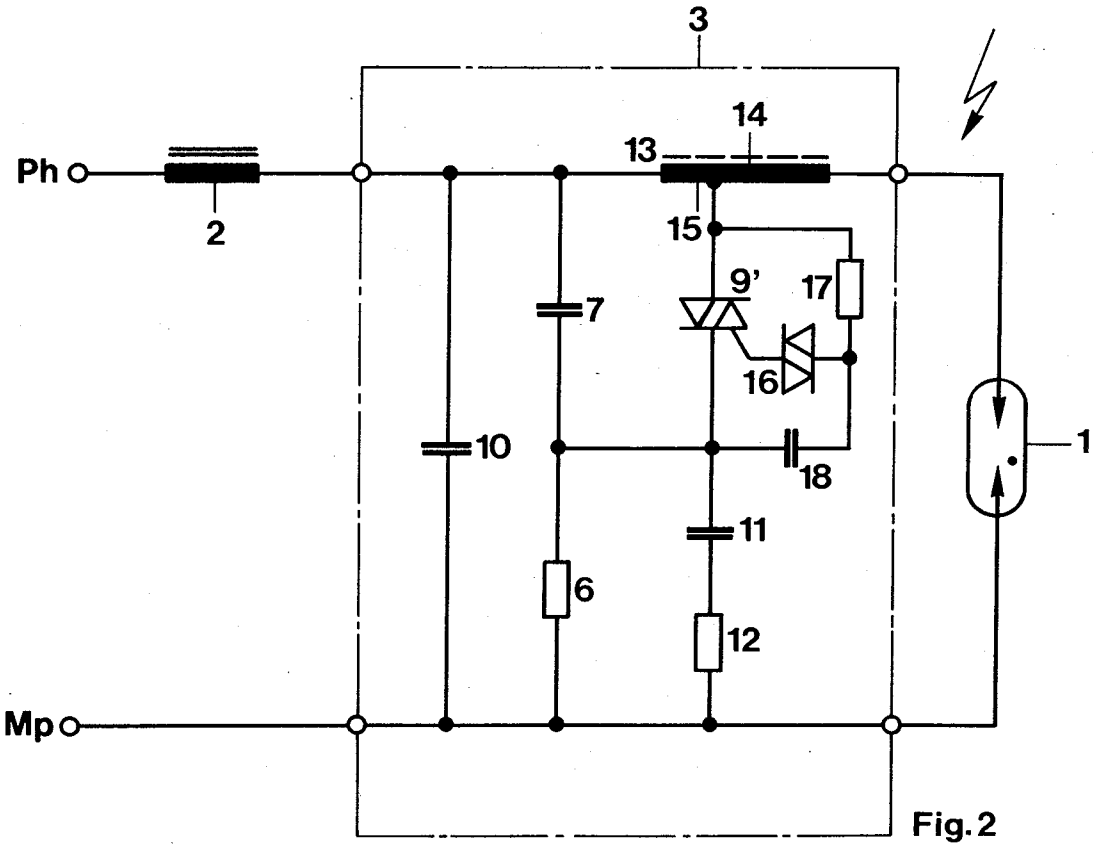
FIG. 2 is a diagram similar to FIG. 1 and using an auto transformer.

The arrangement of FIG. 2 is similar to that of FIG. 1, and the same elements have been given the same reference numerals. The basic difference is that the transformer is an auto transformer 13 having a primary winding 15 and a secondary winding 14. The other elements may have the same dimensions and characteristics as those explained in connection with FIG. 1. They are reversely connected with respect to the illustration of FIG. 1, which does not, however, in any way change the operation of the system. In other words, the particular position of the damping resistor 6 and the capacitor 7, for example, is reversed.

In an operating example for a lamp of the type high pressure sodium of 70 watts, for a voltage of 220 V at 50 Hz, the following elements are suitable:

choke 2: impedance 187 Ohms
capacitor 7: 0.047 $\mu$F
capacitor 11: 0.1 $\mu$F
charge resistor 6: 11 K$\Omega$
damping resistor 12: 1 K$\Omega$/1 W As an additional change, FIG. 2 shows that rather than using a four-layer diode 9, a triac 9' can be used controlled, for example, by a diac 16 which is connected to a voltage divider consisting of resistor 17 and capacitor 18.

Various changes and modifications may be made within the scope of the inventive concept, and features described with any one embodiment may be used with the other, within the inventive concept.

I claim:

1. Ignition or starter circuit for a high-pressure metal vapor discharge lamp (1) adapted for connection to two terminals (Ph, Mp) of an electrical current supply source, having a ballast choke (2);

a pulse transformer (4, 13) and a pulse capacitor (7) connected in an ignition starting pulse superimposition circuit;

a series circuit including an auxiliary capacitor (11) and a damping resistor (12);

and a switching element (9) serially connected with said series circuit for disconnection of the series circuit after ignition of the lamp, wherein, in accordance with the invention, the series circuit of the auxiliary capacitor (11) and the damping resistor (12) is integrated in the circuit of the ignition pulse superimposition circuit and forms, together with said ballast choke, a series oscillatory circuit connected to the primary (8, 15) of the pulse transformer (4, 13) which, upon oscillation of said oscillatory circuit, increases the voltage applied to the lamp upon starting at sequential oscillatory undulations to thereby reliably insure starting of the lamp.

2. Circuit according to claim 1, wherein the switching element (9) comprises a symmetrically switching voltage-sensitive semiconductor switch.

3. Circuit according to claim 2, wherein said switching element comprises a four-layer diode.

4. Circuit according to claim 2, wherein said switching element comprises a triac.

5. Circuit according to claim 1, wherein said series circuit of the auxiliary capacitor (11) and the damping resistor (12) is connected in series with the primary (8, 15) of the transformer (4, 13) and through said switching element (9);

and the series oscillatory circuit formed by the ballast choke (2), the auxiliary capacitor (11) and the damping resistor (12), has a frequency of oscillation in the order of about 1 kHz.

6. Circuit according to claim 1, wherein said series circuit of the auxiliary capacitor (11) and the damping resistor (12) is connected in series with the primary (8, 15) of the transformer (4, 13) and through said switching element (9);

the series oscillatory circuit formed by the ballast choke (2), the auxiliary capacitor (11) and the damping resistor (12), has a frequency of oscillation such that sequential oscillatory undulations follow each other at a rate insufficient for extinction of the lamp after first start or ignition striking thereof.

7. Circuit according to claim 6, wherein the sequence of oscillatory undulations follow each other by a time of about 0.5 millisecond.

8. Circuit according to claim 6, further including a radio frequency suppression capacitor (10) connected across the series circuit formed by the auxiliary capacitor (11), the damping resistor (12) and the switching element, the pulse capacitor (7) and a charge resistor (6) therefor being connected across said suppression capacitor (10).

* * * * *